United States Patent [19]

Anderson et al.

[11] 4,439,089

[45] Mar. 27, 1984

[54] BOOM ARM WITH ROCK DEFLECTION FEATURE

[75] Inventors: Rodney H. Anderson, Libertyville; Thomas M. Cameron, Waukegan, both of Ill.

[73] Assignee: Dresser Industries, Inc., Dallas, Tex.

[21] Appl. No.: 270,171

[22] Filed: Jun. 3, 1981

Related U.S. Application Data

[63] Continuation-in-part of Ser. No. 950,937, Oct. 12, 1978, abandoned.

[51] Int. Cl.[3] ..... B66C 23/00; E02F 3/76; E04C 3/30

[52] U.S. Cl. ..... 414/722; 414/727; 52/731; 212/261; 212/266

[58] Field of Search ..... 414/722, 727, 680, 697, 414/914; 52/119, 730, 731; 37/117.5, 118 R, 118 A; 212/266; 254/124

[56] References Cited

U.S. PATENT DOCUMENTS

| | | | |
|---|---|---|---|
| T966,007 | 1/1978 | Liehr et al. | 414/697 |
| 2,083,226 | 6/1937 | Dornier | 52/731 |
| 2,668,631 | 2/1954 | Reese | 37/117.5 X |
| 3,273,299 | 9/1966 | Hartung, Jr. | 52/731 X |
| 3,722,864 | 3/1973 | Borer et al. | 254/124 |
| 4,064,947 | 12/1977 | Cole | 52/731 |
| 4,134,507 | 1/1979 | Piercy et al. | 414/727 |
| 4,156,488 | 5/1979 | Stark | 52/731 X |
| 4,162,872 | 7/1979 | Grooss et al. | 414/727 X |
| 4,260,322 | 4/1981 | Cameron | 414/727 |

FOREIGN PATENT DOCUMENTS

| | | | |
|---|---|---|---|
| 1484978 | 5/1969 | Fed. Rep. of Germany | 52/731 |

*Primary Examiner*—Robert J. Spar
*Assistant Examiner*—Terrance L. Siemens
*Attorney, Agent, or Firm*—J. N. Hazelwood; B. E. Deutsch

[57] ABSTRACT

A loader vehicle boom arm assembly incorporates a pair of box section boom arms in which the top plate of each box section boom arm has a cross sectional shape such that the upper surface is provided with an arcuate surface that directs foreign objects encountering the arcuate top surface off the boom arm.

1 Claim, 4 Drawing Figures

BOOM ARM WITH ROCK DEFLECTION FEATURE

BACKGROUND OF THE INVENTION

This application is a continuation-in-part of application Ser. No. 950,937 filed Oct. 12, 1978 titled "Boom Arm With Rock Deflection Feature", now abandoned.

FIELD OF THE INVENTION

The invention has to do with the shape of loader boom arms or lift arms. More specifically, the invention is primarily a rock deflecting top plate used on loader boom arms. The top plate is roll formed with a cross sectional shape to provide a J-groove weld bed and to provide a contoured or arcuate top surface.

DESCRIPTION OF THE PRIOR ART

Construction equipment used in excavating, mining, land reclamation, and other typical situations where a bucket mounted to the boom arms of a loader vehicle is used to load or transport material is subjected to extremely hard use and unusual encounters with the environment. It is common to see a significant amount of spillage as a bucket is initially loaded by an aggressive operator, however, in the interest of efficiency this spillage usually occurs as the bucket is loaded and thus spills back into a source pile.

Some spillage may also occur when transporting a full load of unstable material at speed across a construction site. Also some spillage may occur as the bucket is raised preparatory to it being dumped into the bed of a dump truck or a hopper. The invention is directed to minimizing damage from this type of spillage.

The invention disclosed herein may be used on loader vehicles having box beam type boom or lift arms. The prior art box section boom arms are typically made either of channel section left and right side members that are welded together at the edges thereof to form the box or alternatively of four plates, two plates being side plates and one of each the others being respective top and bottom plates. In these two embodiments the top surface has always been a relatively flat surface.

It has been found that the top plate upper surface of the box section boom arms will occasionally provide a path that spillage from the loader bucket will follow if any material should happen to fall out of the bucket when the bucket is maised to an elevated position. Material spilling out of the bucket may fall onto the top surface of the loader arm and travel down the loader arm a significant distance. If a rock, for instance, falls out of the bucket onto the top of the boom arms there is some potential that the rock will roll down the length of the boom arm and contact the vehicle in an area not provided with structural strength sufficient to be undamaged by the impact of the rock.

One of the more typical solutions to the problem would be to provide the bucket with a load containing extension that would contain any possible spillage. Another possible solution would be to weld vertical transverse barriers across the top of the boom arms. A further solution would be to weld a longitudinal vertical fin along the entire length of the top surface of the boom arm. It is not known whether these solutions exist in the prior art, however, it is felt that they may be obvious. Unfortunately, each of these solutions require extra operations in the fabrication of the boom while execution of the invention disclosed in this specification can provide a rock deflector integral with the boom arm top plate at no additional cost over a conventional top plate.

SUMMARY OF THE INVENTION

A box beam boom arm is provided with a top plate having a transverse cross sectional shape providing an arcuate crown surface to direct any material inclined to roll longitudinally down the top plate off the top plate.

The top plate is also provided with contoured edges that when assembled to the sidewalls of a box beam boom arm form a J-groove weld bed providing a multitude of advantages.

One of the objects of this invention is to provide a box beam boom arm that has a shape on an upper surface thereof that discourages loose material from remaining on the top surface of the boom arm.

Another object of this invention is to provide a material deflection means that can be incorporated into the design of the boom arms without any appreciable increase in boom arm manufacturing cost.

It is also an object of this invention to provide material deflection means that is aesthetically pleasing and unobtrusive in its incorporation into the boom arm assembly.

These and other objects and advantages will become apparent from an understanding of this disclosure.

BRIEF DESCRIPTION OF THE DRAWING FIGURES

DETAILED DESCRIPTION OF THE INVENTION

Figure 1:
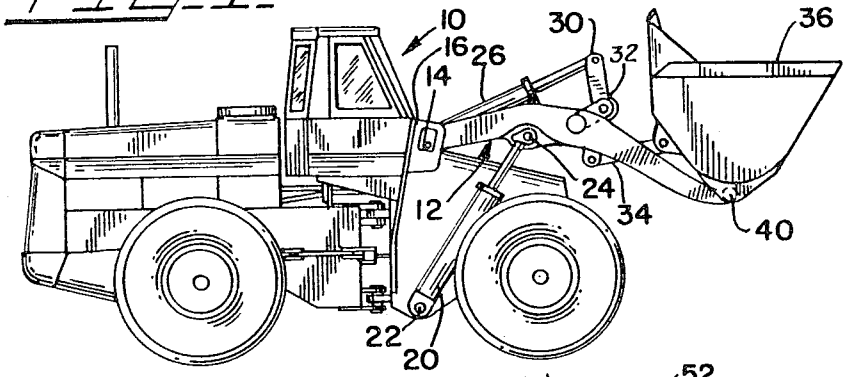
FIG. 1 is an elevation view of a loader vehicle incorporating the invention.
Figure 2:
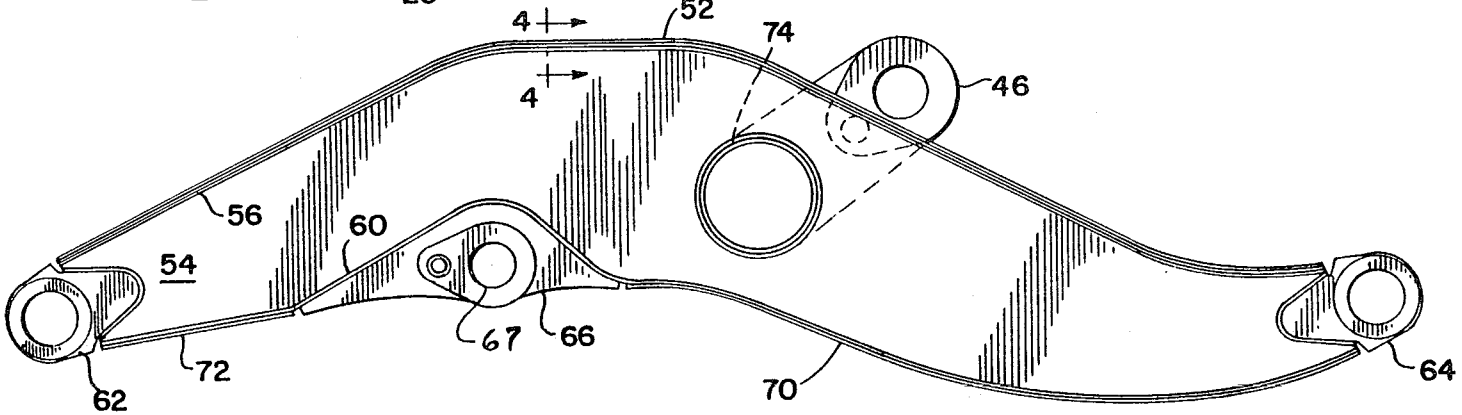
FIG. 2 is an elevation view of a boom arm utilized in FIG. 1 before the components of the boom arm have been welded together.

The excavating loader shown generally as 10 in FIG. 1 is an example of a typical mobile material handling vehicle that would incorporate the invention. A boom arm assembly generally 12 is pivotally mounted at pivot point 14 to the front portion 16 of the conventional articulated loader. A boom lift cylinder 20 is pivotally grounded to the front portion of hte loader at 22 and pivotally mounted to the boom arm assembly generally 12 at pivot point 24. Bucket actuating cylinder 26 is pivotally grounded to the front portion of the vehicle and the rod thereof is pivotally connected to the bell crank 30 which is pivotally supported on the cross tube extensions 32 which are integral with the boom arm assembly generally 12. A bucket link 34 is pivotally mounted at its respective ends to the lower pivot point of the bell crank and a pivot point on the bucket 36. The bucket 36 is pivotally mounted to the boom arm assembly at pivot point 40. FIG. 2 presents a side elevation view of the general boom arm assembly that has the various parts located in the final positions relative to each other but have not yet been finally welded together. The figure shows the outboard side of the right side boom arm 42 of FIG. 3 but is intended to be representative of identical parts on the left side boom arm 44 as well as the cross tube extension 46 and 50.

The side wall 54 is cut from plate stock to provide a flat plate such that the upper edge 56 and the lower edge 60 present surfaces that are straight cut such that a plane of each edge is perpendicular to the outboard surface, i.e., the surface that is seen as contrasted to the inboard surface of the sidewall which constitutes the inner walls of the box beam. Both a first and a second sidewall are similarly cut. The sidewalls are disposed in a spaced parallel manner so that the second sidewall is spaced apart from and longitudinally aligned with the first sidewall. Each end of the boom arm is provided with a boom arm end, first and second 62 and 64 respectively, in this embodiment shown as castings, which are welded to each end of said box section boom arms. Each casting is formed with a sidewall contacting portion forming a weld bed and each is provided with a through bore to accommodate pins attaching the boom arm to the loader frame 16 and the bucket 36.

A boom pocket casting 66 is positioned in the lower section of the boom arm and is welded to the inboard (not seen) and the outboard 54 sidewall as well as to the adjacent ends of the forward bottom plates 70 and the rear bottom plates 72. This casting is also formed with a sidewall contacting portion forming a weld bed and is welded in position to said lower edge of the first and second sidewalls between the forward 70 and rear 72 bottom plates. The boom pocket casting 66 has a through bore 67 defining a centerpoint.

A torque tube casting 74 that supports right 46 and left 50 (FIG. 3) cross tube extension or bellcrank pivot members is welded to the inboard sidewalls 76 on the left and right side boom arms connecting one of said boom arms to the other.

Each bellcrank pivot member is provided with a through bore having a centerpoint as is shown in right bellcrank pivot member 46 of FIG. 2. The centerpoint of the bore 67 of the boom pocket casting 66 is generally an equal distance from the centerpoint of the throughbore of the bellcrank pivot member and the centerpoint of the through bores of each boom arm end.

The crux of this invention has to do with the cross sectional shape of the top plate 52, its method of manufacture, and the method of attaching the top plate to the sidewalls of the box beam boom arm.

Figures 3, 4:
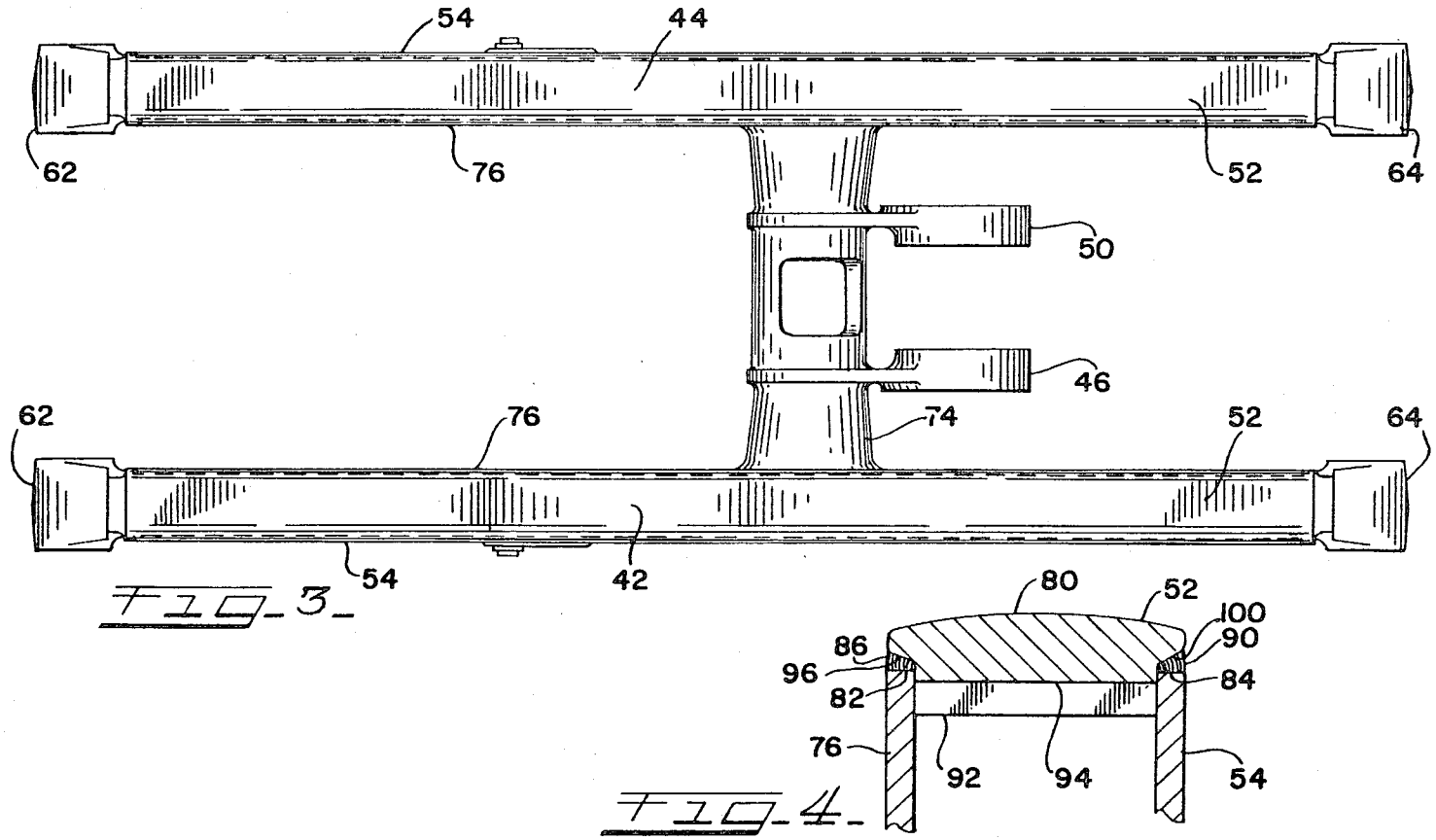
FIG. 3 is a top view of a boom arm assembly showing a pair of boom arms connected together by a torque tube.
FIG. 4 is a cross sectional view of a portion of a boom arm as taken through a plane 4—4 of FIG. 2.

FIG. 4 presents a cross sectional view of a portion of a boom arm as taken through plane 4—4 of FIG. 2. This figure shows the modified top plate 52 and the rock deflecting surface or crown 80. The top plate 52 is positioned and welded between the inboard surface of the inboard sidewall and the inboard surface of the outboard sidewall 54 between the curvilinear upper edges of the first and second sidewalls to join them together. Weld beds 82 and 84 are formed between the top plate 52 and edges of the sidewalls 76 and 54 such that welds 86 and 90 can be provided to attach the top plate 52 to the sidewalls. A locating piece 92 may be welded to the inner surfaces of each sidewall to temporarily hold them in relative alignment until final welding of the entire boom arm is completed. The locating piece 92 may also serve to locate the top plate to ensure that a weld bed of appropriate dimensions is maintained.

The cross sectional shape of the top plate is critical to this invention. The top plate is provided with an arcuate crown 80 on an uppermost surface of the plate. This surface slopes downward from the exterior surface center of the top plate to the edges. The overall width from edge-to-edge of the top plate is the same as the external sidewall-to-sidewall dimension of the box boom arm. The crown effect is carried out throughout the entire longitudinal length of the top plate. The bottom or inboard surface of the top plate is generally a flat surface. The transverse length dimension of this portion of the top plate is equivalent to the distance between the inboard surface of the sidewalls. The edge of the sidewalls are mirror images of each other and they are stepped inwardly from the widest part of the top plate to the narrowest part of the top plate. Thus, in simplified terms the top plate has a transverse cross sectional shape that has a flat inboard surface and an arcuate outboard surface and edges that are stepped down from the outboard surface to the inboard surface of the top plate. The inward step is provided by bevelled surfaces 96 and 100 as shown.

The bottom plates, forward 70 and rear 72, are formed similar to the top plate, however, they have a flat outboard surface as the rock deflecting aspect of the top plate is not needed on the bottom plate. Each bottom plate is welded in position between the lower edges of the first and second sidewalls to join them together. The use of a bottom plate having the same cross sectional shape as the top plate, that is with a transverse cross sectional shape that has an arcuate outboard surface, has been considered and may prove beneficial from a cost standpoint even though no rock deflecting benefit can be derived.

The top plate and the bottom plate are roll formed through a series of progressive dies hence the final cross sectional shape can be slightly revised by replacing only a portion of the dies. This leads to obvious economies when it is desirable to slightly alter the shape of the plates to provide a basis for dimensionally different box beam boom arms.

The operation of the rock deflecting feature of this top plate has been described earlier in this disclosure. The solution can be more easily envisioned through a review of FIGS. 3 and 4. A rock that falls out of the bucket. as it is being elevated, onto the uppermost or crown 80 surface of the top plate will tend to roll off the top plate due to the shape of the crown rather than follow the boom arm toward the boom arm assembly mounting points at the front portion of the vehicle.

It is apparent that a boom arm assembly fully satisfied the objects, aims and advantages as set forth above. While the invention has been described in conjunction with a specific embodiment thereof it is evident that alternatives, modifications and variations may be apparent to those skilled in the art in light of the foregoing description. For instance, as point out in the specification the cross sectional shape of the top plate could also be used on a bottom plate of a boom arm for economic considerations. Alternative host vehicles may also advantageously use the described structure. Accordingly, this disclosure is intended to embrace modifications and variations falling within the spirit of the appended claims.

What is claimed is:

1. A boom arm assembly for use on a loader vehicle having a pair of boom arms; each boom arm having a first sidewall having a curvilinear upper edge and a lower edge, a second sidewall having an upper curvilinear edge and a lower edge disposed in a spaced apart parallel manner with said first sidewall, said first and second sidewalls being flat plates having upper and lower edges straight cut such that each edge presents surfaces perpendicular to a surface of said flat plates; a pair of bottom plates identified as forward and rear bottom plates, each welded to said lower edge of said first and second sidewalls to join them together; a first and a second boom arm end, one boom arm end welded to each respective end of said boom arm, each boom arm end being a casting formed with a sidewall contacting portion forming a weld bed and each boom arm end having a through bore; a boom pocket casting formed with a sidewall contacting portion forming a weld bed welded to said lower edge of said first and second sidewalls between said forward and said rear bottom plates, said boom pocket casting having a through bore defining a centerpoint; a torque tube casting connecting one of said pair of boom arms to the other of said pair of boom arms said torque tube casting including a pair of bellcrank pivot members each having a bore defining a centerpoint whereby said centerpoint of said boom pocket casting is generally an equal distance from said centerpoint of said first boom arm end and said centerpoint of said bore of said bellcrank pivot member; wherein the improvement comprises a top plate welded in position between said curvilinear upper edges of said first and second sidewalls to join them together, said top plate having a transverse cross sectional shape that has a flat inboard surface and an arcuate outboard surface and edges that are stepped down from the outboard to the inboard surface of said top plate.

* * * * *